US007139521B2

(12) United States Patent
Ng et al.

(10) Patent No.: US 7,139,521 B2
(45) Date of Patent: Nov. 21, 2006

(54) GLOSS AND DIFFERENTIAL GLOSS CONTROL METHODOLOGY

(75) Inventors: Yee Seung Ng, Fairport, NY (US); Hwai-Tzuu Tai, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/021,250

(22) Filed: Dec. 21, 2004

(65) Prior Publication Data

US 2005/0169680 A1 Aug. 4, 2005

Related U.S. Application Data

(60) Provisional application No. 60/532,162, filed on Dec. 23, 2003.

(51) Int. Cl.
*G03G 15/20* (2006.01)

(52) U.S. Cl. ..... 399/341; 427/494

(58) Field of Classification Search ..... 399/341; 427/494

See application file for complete search history.

(56) References Cited

U.S. PATENT DOCUMENTS 5,234,783 A 8/1993 Ng
5,371,058 A 12/1994 Wittig, Jr. et al.
5,666,592 A 9/1997 Aslam et al.
5,887,234 A 3/1999 Aslam et al.
5,890,032 A 3/1999 Aslam et al.
5,956,543 A 9/1999 Aslam et al.
6,438,336 B1 * 8/2002 Bengtson ..... 399/67
2003/0007814 A1 * 1/2003 Richards ..... 399/341
2004/0131403 A1 * 7/2004 Nakamura et al. ..... 399/341

OTHER PUBLICATIONS

Ng et al., "Standardization of Perceptual based Gloss and Gloss Uniformity for Printing Systems" (INCITS W1.1), IS&T's 2003 PICS Conference, pp. 88-93.

* cited by examiner

*Primary Examiner*—David M. Gray
*Assistant Examiner*—Joseph S. Wong
(74) *Attorney, Agent, or Firm*—Carl F. Ruoff

(57) ABSTRACT

Gloss, differential gloss, and image relief of a printed image may be controlled by utilizing a combination of technologies in the appropriate manner. These technologies include the use of transparent toner overcoats, negative transparent toner masks, variable screen transparent toner screen masks, UV coaters, and post-press belt fusing. Unlike conventional systems, which may increase gloss at a cost of also increasing image relief, the present invention may produce an image having a controlled gloss, differential gloss, and image relief.

9 Claims, 6 Drawing Sheets

| | |
|---|---|
| FIG. 2A | FIG. 2B |

GLOSS AND DIFFERENTIAL GLOSS CONTROL METHODOLOGY

CROSS-REFERENCE TO RELATED APPLICATION

Reference is made to the co-pending, commonly assigned, U.S. Provisional Patent Application Ser. No. 60/532,162 filed on Dec. 23, 2003, entitled: GLOSS AND DIFFERENTIAL GLOSS CONTROL MEHODOLOGY, the disclosure of which is incorporated herein by reference.

FIELD OF THE INVENTION

The present invention generally relates to controlling gloss and differential gloss, and more specifically, controlling gloss and differential gloss while maintaining flexibility in media selection, reducing differential gloss and image relief, improving fuser reliability and lifespan, and enhancing overall gloss control.

BACKGROUND OF THE INVENTION

In high-speed, high-quality electrophotographic printing applications, it may be desirable to get high gloss on the pictorial areas of an image but not on the text areas (i.e., differential gloss). As described in U.S. Pat. No. 5,234,783, issued to Ng, herein incorporated in its entirety by reference, this may be accomplished by selectively putting a transparent toner overcoat on the pictorial area. One example described in the Ng patent makes use of a lower viscosity toner so that there can be a higher gloss in the pictorial areas.

However, with high speed and high quality printing, there still can be disadvantages from the viewpoint of achieving higher gloss with heated roller fusing. For example, too much total toner coverage on the media may stress the fusing subsystem. Moreover, at the higher temperatures required to fuse a transparent toner overcoat along with the color toner lay-down, roller reliability as well as artifacts from the fuser roller oiler may become problematic. Additionally, there may also be problems relating to image relief differences between toner-covered areas versus adjacent areas without the transparent toner overcoat.

Other conventional systems to increase image gloss include an ultraviolet (UV) curable overcoat that may be applied over the total image or over, for example, only pictorial portions of the image. The UV curable overcoat may be applied by a conventional commercial printing coater or by ink jet printing, wherein a specific area may be coated selectively. However, with UV curable inks, even though image protection may be achieved over a wide variety of media, only certain types of coated media can benefit from the UV coating to lower differential gloss. In some cases, with uncoated matte media for example, differential glass can get worse with UV coating. Moreover, because most UV curable ink layers are a few microns thick, image relief may be quite visible on the dry electrophotographic prints.

As can be seen, there is a need for improved control of differential gloss on a wide variety of media substrates while minimizing image relief that may result from certain conventional differential gloss control methods.

SUMMARY OF THE INVENTION

As will be discussed in more detail below, a variety of technologies may be used to maintain flexibility in media selection, reduce differential gloss and relief, and improve fuser reliability and lifespan. These technologies include, for example, transparent toner overcoat, negative transparent toner masks, variable transparent toner screen mask, UV coater (off-line or ink jet), belt fusing, and transparent toner compensation for height relief. These technologies, when appropriately selected and applied, may be used to achieve overall appearance control for high quality and high-speed images.

The term "appearance" as used herein refers to those qualities well known in the art to those in the printing field. Such qualities include, for example, gloss, color density, differential gloss, and image relief.

The term "differential gloss" as used herein refers to the differences in image gloss among different portions of the same printed page.

The term "image relief" as used herein refers to differences in image surface heights along the same printed page.

The term "low differential gloss" as used herein refers to a difference in gloss value along a printed page of less than about 30 (in G60 units, for reference, please see Yee Ng, et al, "Standardization of Perceptual based Gloss and loss Uniformity for Printing Systems (INCITS W1.1)", IS&T's 2003 PICS Conference Proceedings, pp. 88–93, 2003), in some instances less than about 20, and in other instances less than about 10.

The term "in-line" as used herein refers to a process occurring without user intervention, usually within the same apparatus as a previous process, while the term "off-line" as used herein refers to a process occurring after a break in the overall process, usually requiring the user to continue the process on a different apparatus or at a different location on the same apparatus.

In one aspect of the present invention, a method for controlling gloss and/or differential gloss of a printed image provides applying a color toner lay-down onto a media substrate to form a pre-fused image; applying a transparent toner over at least a portion of the pre-fused image to form a coated pre-fused image; fusing the coated pre-fused image to form a fused print; and finishing the fused print to increase a gloss value of the fused print.

In another aspect of the present invention, a method for controlling gloss and/or differential gloss of a printed image provides applying a color toner lay-down onto a media substrate to form a pre-fused image; applying a transparent toner over at least a portion of the pre-fused image as a negative mask to form a coated pre-fused image; selecting parameters for the negative mask to obtain a desired level of at least one of gloss, differential gloss and image relief; fusing the coated pre-fused image to form a fused print; and finishing the fused print to increase a gloss value of the fused print.

In yet another aspect of the present invention, a method for controlling gloss and/or differential gloss when creating a printed image on a printing device provides applying a color toner lay-down onto a media substrate to form a pre-fused image; fusing the coated pre-fused image to form a fused print; and finishing the fused print to increase a gloss value of the fused print.

In a further aspect of the present invention, a color image printing device provides a four-station color lay-down section for applying color toner to a media substrate to form a pre-fused image; a fifth station section for applying transparent toner to the pre-fused image; a fuser for fusing the pre-fused image into a fused image; and at least one of an in-line ink jet overcoat application device, an off-line ink jet overcoat application device, an in-line ultraviolet overcoat application device, and an off-line ultraviolet overcoat application device for increasing a gloss value of the fused image.

In still another aspect of the present invention, a computer readable media for controlling at least one of gloss and differential gloss of a printed image on a substrate provides a code segment for obtaining a desired level of gloss and differential gloss from a user; a code segment for reading an original image from which the printed image is to be made and calculating a color toner lay-down of the original image; a code segment for calculating an appropriate negative mask application of transparent toner based on at least one of the color toner lay-down of the original image, the desired level of gloss and differential gloss and the substrate.

These and other features, aspects and advantages of the present invention will become better understood with reference to the following description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides for the controlling of differential gloss of a printed image while minimizing the negative effects of image relief. Conventional methods may use a transparent toner overcoat to achieve low differential gloss, high overall gloss, and image protection. However, often times conventional methods result in image relief that is unacceptable to the end customer. Further, the amount of transparent toner overcoat needed may stress the heated fuser roller, as an increase in the amount of transparent toner overcoat results in an increase in the amount of heat needed to fuse the toner (color lay-down plus transparent overcoat) onto the media substrate. By using a variety of technologies according to the present invention, such as transparent toner overcoat, negative transparent toner masks, variable transparent toner screen masks, UV coater (off-line or ink jet), belt fusing, and transparent toner compensation for height relief, one may achieve high overall image gloss and low differential gloss as well as protection for the fused image.

Figure 1:
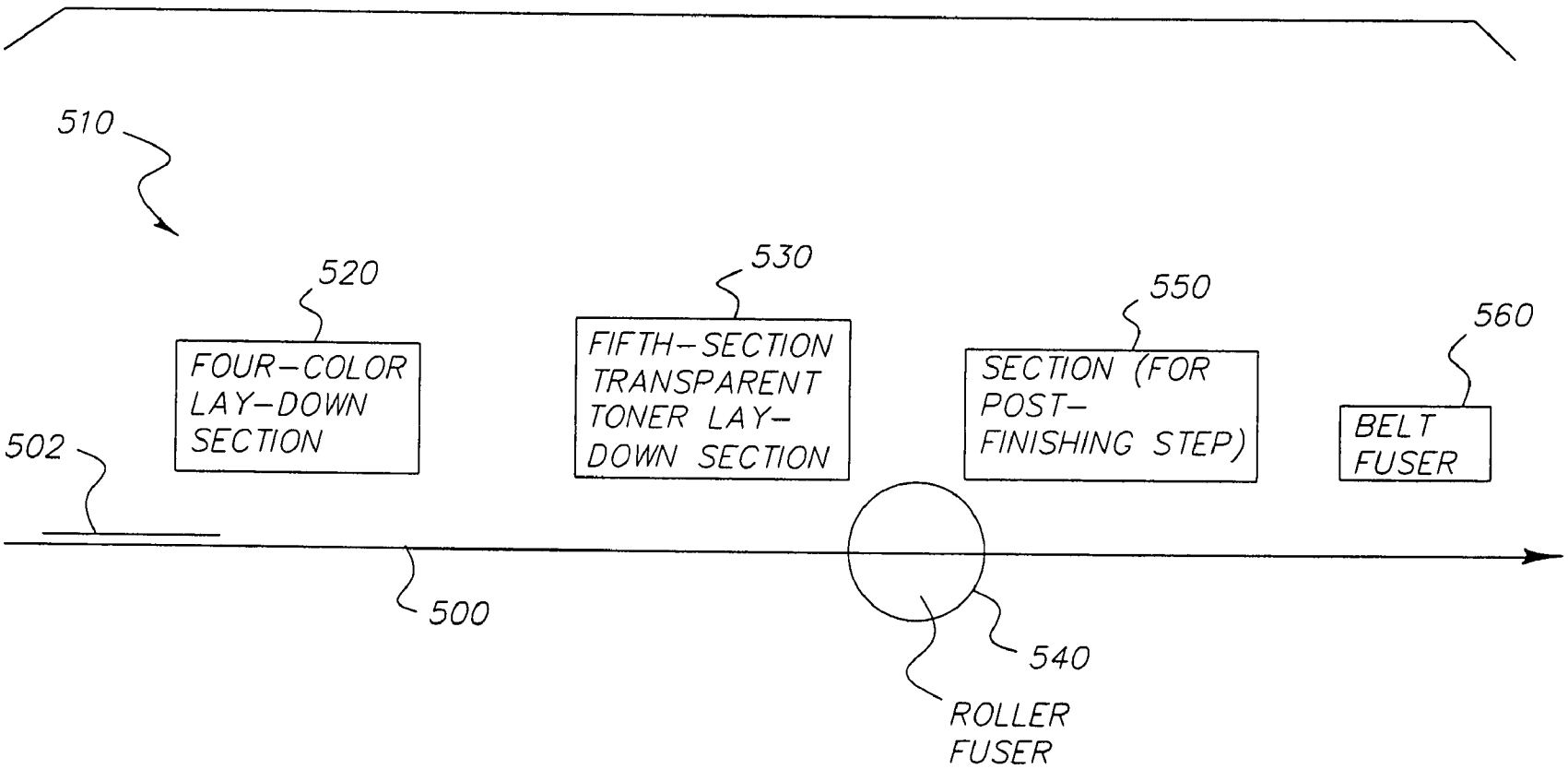
FIG. 1 shows a schematic sketch of a paper path through a printing device according to the present invention.

Referring to FIG. 1, there is shown a schematic sketch of a paper path 500 through a printing device 510 according to the present invention. Along paper path 500 there may be disposed a four-color toner lay-down section 520 for laying colored toner onto a substrate 502 to form a pre-fused image. Next, along paper path 500, there may be disposed a fifth section, transparent toner lay-down section 530, for laying down transparent toner onto the pre-fused image. Once transparent toner is laid down, the substrate 502 may be fused with a roller fuser 540 to produce a fused image. Following fusing, a post-fusing finishing step may include at least one of an in-line ink jet overcoat application device, an off-line ink jet overcoat application device, an in-line ultraviolet overcoat application device, and an off-line ultraviolet overcoat application device (each of these devices may be present in section 550) for increasing a gloss value of the post-fused image. Finally, the finished image may be further processed through a belt fuser 560 for further increasing the gloss value of the final product.

Figures 2, 2B:
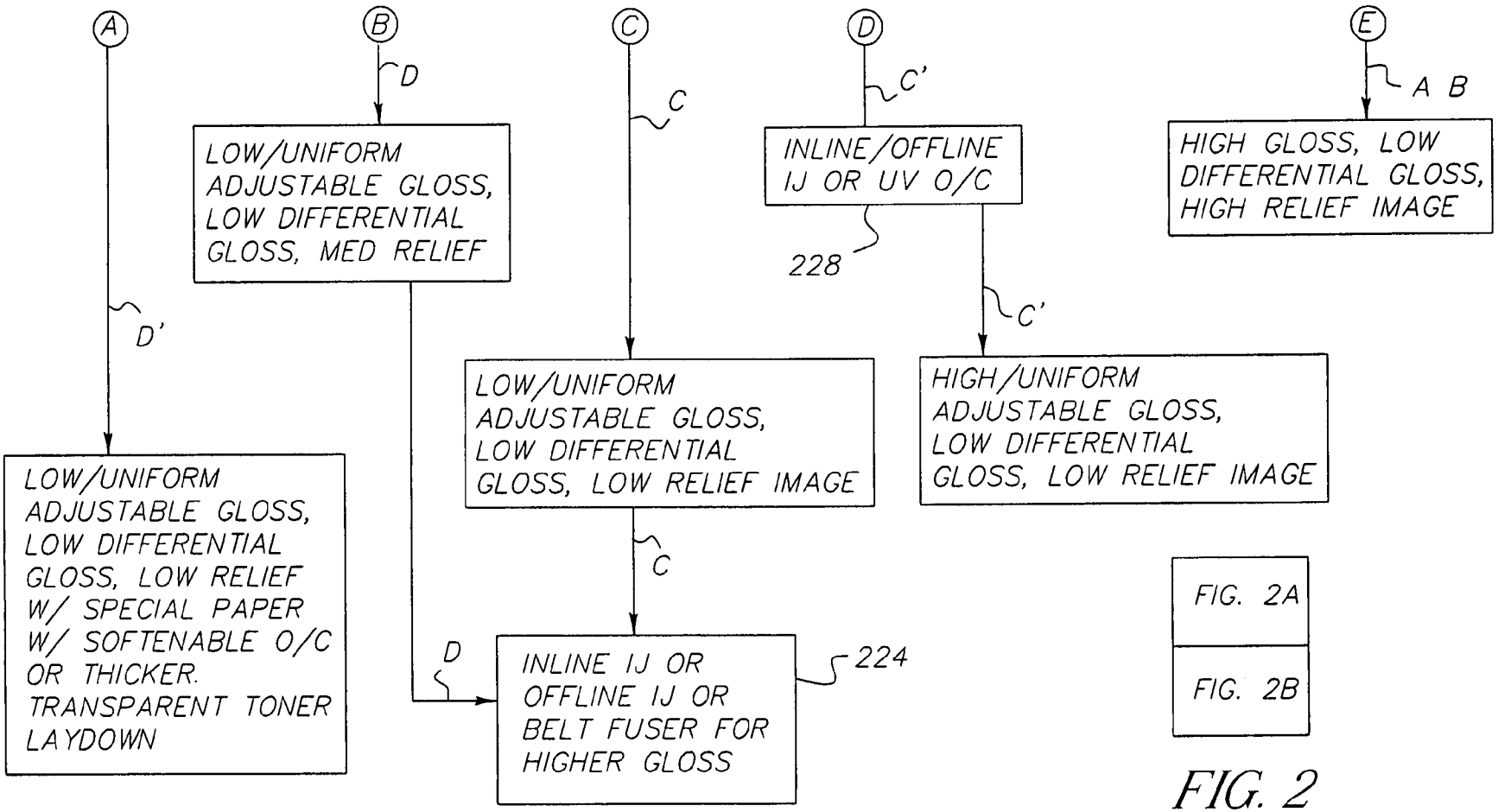
FIGS. 2A and 2B shows methods for controlling differential gloss on glossy coated paper according to one embodiment of the present invention.
Figure 2A:
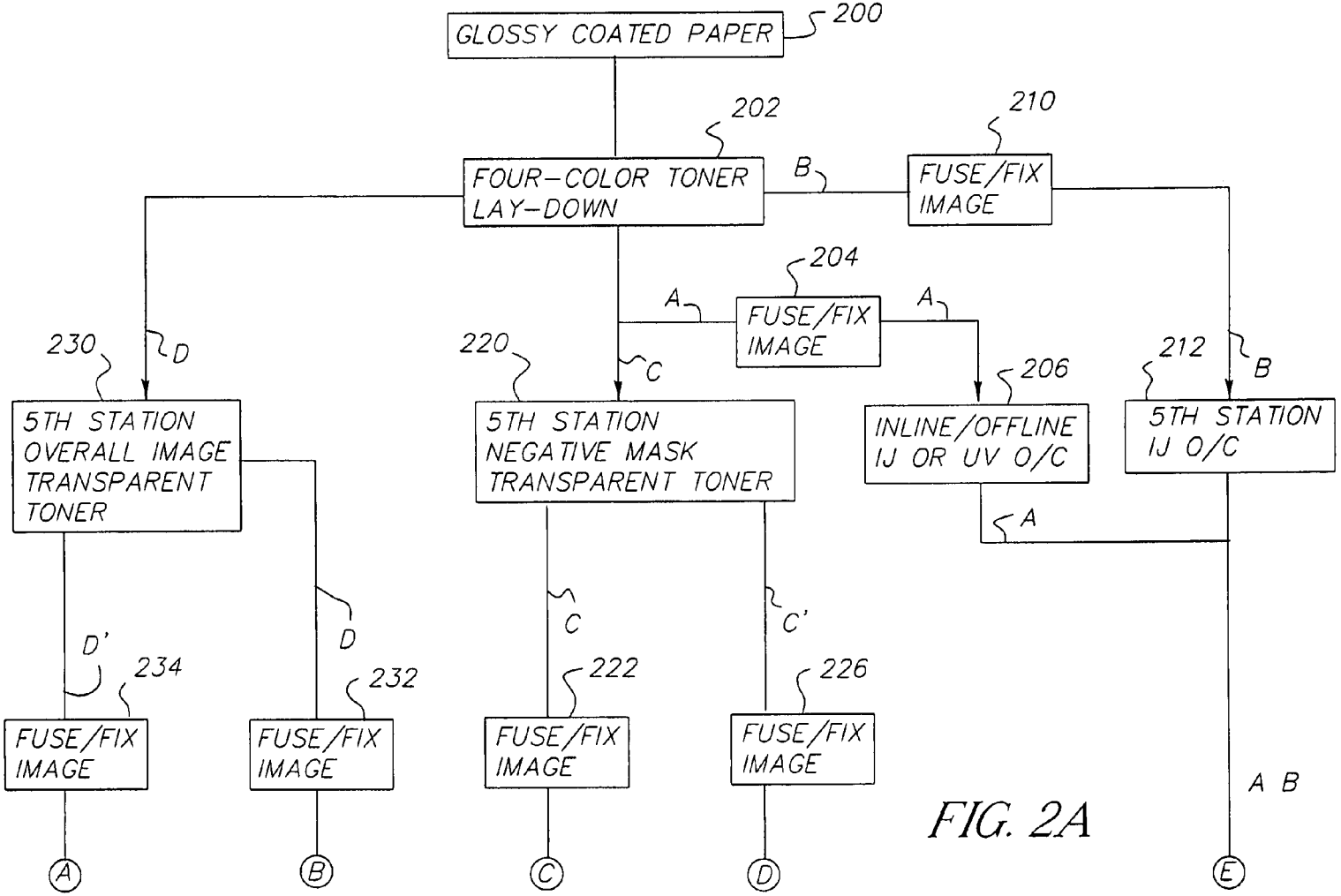

Referring to FIGS. 2A and 2B, there is shown a flow chart for various methods of differential gloss control using a glossy coated paper substrate 200. After the conventional, well-known process of laying down the four-color toner 202, the process of the present invention sub-processes into one of four main sub-processes—A, B, C, and D. Broadly, and as will be discussed in more detail below, sub-process A uses an ink jet or ultraviolet overcoat either in-line or off-line to generate a high gloss, low differential gloss, high relief image print. Sub-process B uses the printer's fifth station to apply an ink jet overcoat to obtain a similar (to sub-process A) high gloss, low differential gloss, high-relief image print. Sub-process C uses the printer's fifth station to lay down a negative mask transparent toner layer following four-color toner lay-down. Finally sub-process D uses the printer's fifth station to lay down a layer of transparent toner over the entire surface of the image.

In the case of glossy coated media 200, after color toners were laid down (step 202) by the four color stations, the toned image can be fused (step 204 in sub-process A or step 210 in sub-process B) by regular heated roller fusing at high speed to get to a certain degree of gloss. Alternatively, the toned image may be fused with a smooth belt fuser to get to even higher gloss. One example of heated roller fusing may be found in U.S. Pat. No. 5,956,543. Examples of belt fusing may be found in U.S. Pat. Nos. 5,666,592; 5,890,032; and 5,887,234. Each of these patents is herein incorporated in their entirety by reference.

Due to different gloss levels of coated media, only a small number of media types are able to produce a relatively uniform gloss (i.e., small differential gloss, for example a differential gloss less than about 20) with varying amounts of toner coverage.

One method, as shown in sub-process A, to enhance overall image gloss while minimizing differential gloss may include using an in-line or off-line UV overcoat, as shown in step 206, that may be applied to the fused images (after step 204). Due to the similar level of adsorption of the UV overcoat into the coated media with respect to the toner-covered area, high gloss with low differential gloss can be achieved. High adjustable gloss (for example, a gloss value greater than 60) can be achieved with the proper selection of UV curable ink while maintaining low differential gloss. Image protection may also be achieved by this method. UV curable inks are known in the art for both image protection and imparting gloss. Examples of UV curable ink may be found in U.S. Pat. No. 5,371,058, issued to Wittig et al., herein incorporated in its entirety by reference.

However, because the UV overcoat can be quite thin (~2 μm) compared with the toner coverage (for example, 280% maximum total four-toner coverage), high relief images can be seen. An appearance of larger color gamut may be achieved due to the increase in gloss. Therefore, lower toner coverage may be used to obtain a similar gamut compared with the original four-color toned images with this overcoat technique, thereby reducing relief images.

Another method, as shown in sub-process B, to accomplish a similar result as above (i.e., high gloss, low differential gloss, high relief image, and image protection) may include using an ink jet with UV ink, as shown in step 212, in the fifth station of the high speed printer. Because an ink jet application method is used, this method has the added advantage of being able to selectively gloss some of the image elements on every page. With the proper selection of UV curable ink, high gloss, some adjustable gloss (from varying the locations and amounts of ink jet UV curable ink lay-down), and low differential gloss can be obtained on coated glossy media. Of course, like the UV overcoat method of sub-process A previously discussed, the method of sub-process B also may produce high relief images on the toner-covered images. However, lower toner coverage may be possible to obtain a similar gamut compared with the original four-color toned image with the ink jet overcoat technique. Inks other than UV curable ink, such as thermal cross-linkable ink, can also be used for this purpose.

As shown in sub-process D, transparent toner overcoat may be used in the fifth station of the high-speed printer as shown in step 230. Regular heated roller fusing (step 232) may then be used to obtain a certain degree of uniform (i.e., lower differential gloss as compared to the four-color images) adjustable gloss in the printed image. Lower relief, as compared with the UV overcoat methods (sub-processes A and B) previously discussed, can be achieved due to the larger layer thickness (for example, >2 μm) of the toner overcoat. However, due to the thick transparent toner overcoat layer, in-line heated roller fusing may not have sufficient power to achieve a high gloss image. Gloss enhancements, after fusing the transparent toner overcoat, may be accomplished by either in-line ink jet UV system/curer or an off-line UV ink coater/curer, as shown in step 224. In this case, a wide range of paper may be used without the problem of differential surface adsorption (between toner laid down areas and non-toner laid down areas), since now the adsorption surface onto which the UV curable ink is applied is defined by the transparent toner overcoat surface rather than the paper surface (which may have varying surface adsorptions). Gloss enhancement may also be achieved in the above-described sub-process D by using a belt fuser on the previously roller-fused image (also shown in step 224). Alternatively, as shown in sub-process D', overall gloss may be enhanced by using a high gloss special paper that has a softenable, polymer-based overcoat that the toner can be buried within. Fusing (roller-fusing with optional belt fusing) of this special paper, as shown in step 234, with the transparent toner overcoat layer may achieve a printed image with low differential gloss and low relief image.

Referring still to FIGS. 2A and 2B, sub-process C may use a fifth station negative mask transparent toner at step 220 to achieve high gloss for high speed printing applications. A negative transparent toner mask is the negative of the four-color image in terms of toner height, so the overall toner image height is uniform across the page. Because the original image is known, the toner lay-down coverage may be calculated by any well-known method in the art. From this calculation, the amount of transparent toner negative mask may be determined based upon the user's desired gloss, differential gloss and image relief, by using, for example, the curve of FIG. 4, as described in more detail below. After application of the negative mask transparent toner in step 220, the image may be fixed or fused in step 222 (sub-process C) or step 226 (sub-process C').

If higher gloss is desired, then an in-line or off-line ink jet UV system/curer or regular UV coater/curer can be used, as shown in step 228, to bring up the overall gloss of the image while still retaining the low differential gloss and low relief images. Another method for increasing the overall image gloss may include using a post-press belt fuser, as shown in step 224 and as previously described. A further method for obtaining in-line gloss enhancement of low differential gloss and low relief images at high speed is to use an in-line ink jet UV overcoat system, as shown in step 228.

While FIGS. 2A and 2B shows each of these methods (sub-processes A, B, C, and D) as leading to a single result, a combination of methods may be used. For example, the glossy coated paper may be passed through fifth station negative mask transparent toner in step 220, coated with an ink jet or UV overcoat, as shown in step 228, and then passed through a belt fuser, as shown in step 224, to achieve high gloss and low differential gloss.

Figure 3:
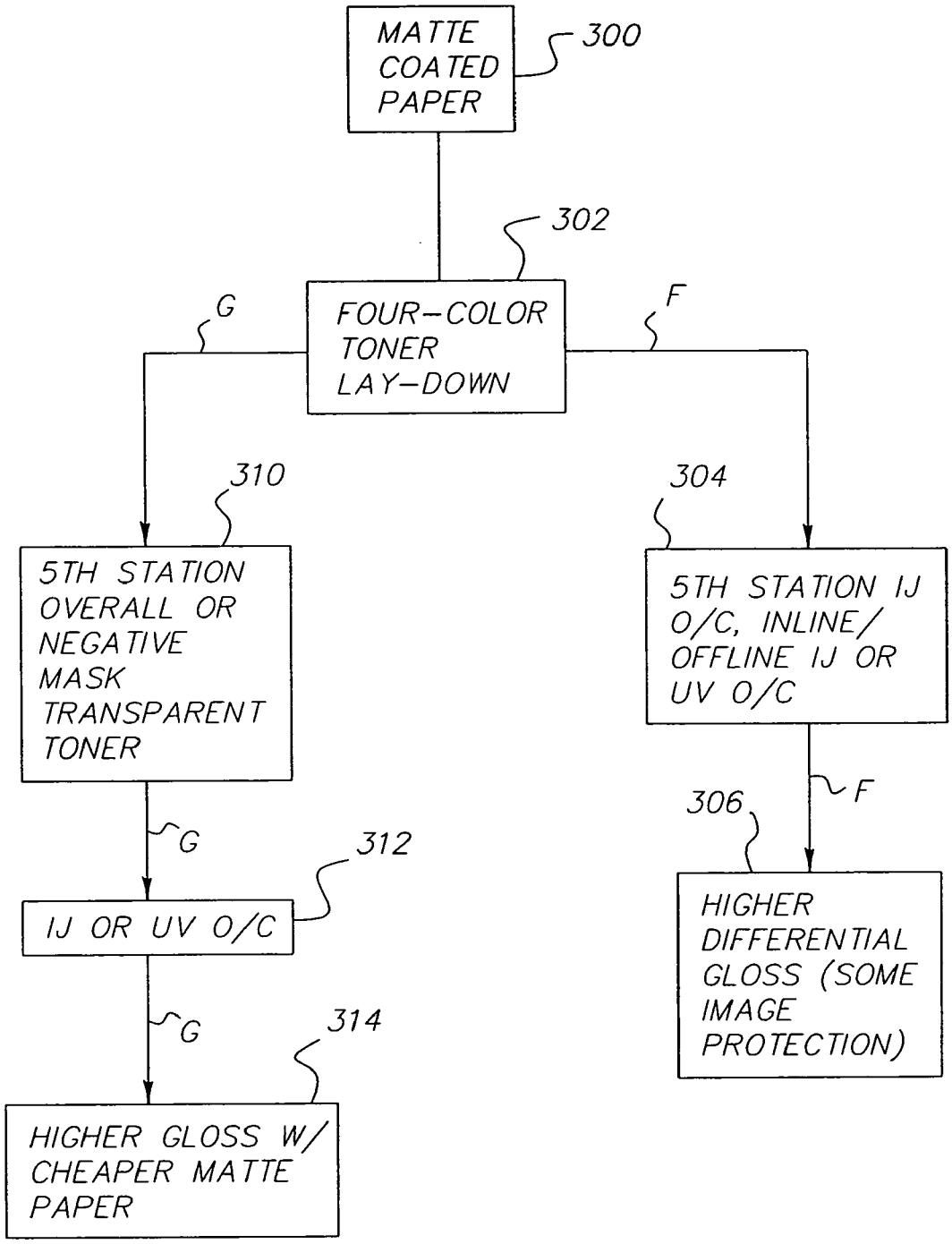
FIG. 3 shows methods for controlling differential gloss on matte coated paper according to one embodiment of the present invention.

Referring to FIG. 3, there is shown a flow chart for various methods of differential gloss control using a matte coated paper substrate 300 having a gloss value from about 5 to about 10. As shown in step 302, a four-color toner lay-down is applied to the matte coated paper substrate. Next, following sub-process F, either a fifth station ink jet overcoat, an in-line or off-line ink jet overcoat, or an in-line or off-line UV overcoat may be applied as shown in step 304 to give a printed image having image protection with some control of differential gloss (for example, a differential gloss from about 20 to about 20). To resolve this problem of differential gloss with matte coated paper, as shown in sub-process G, a transparent toner may be used in the fifth station (either as an overcoat or as a negative mask) (step 310) in conjunction with an ink jet or UV overcoat (step 312) to get high gloss with the less expensive matte paper, as shown in step 314. Optionally, to further increase the gloss of the finished product, the fused image may pass through a post-press belt fuser.

Figure 4:
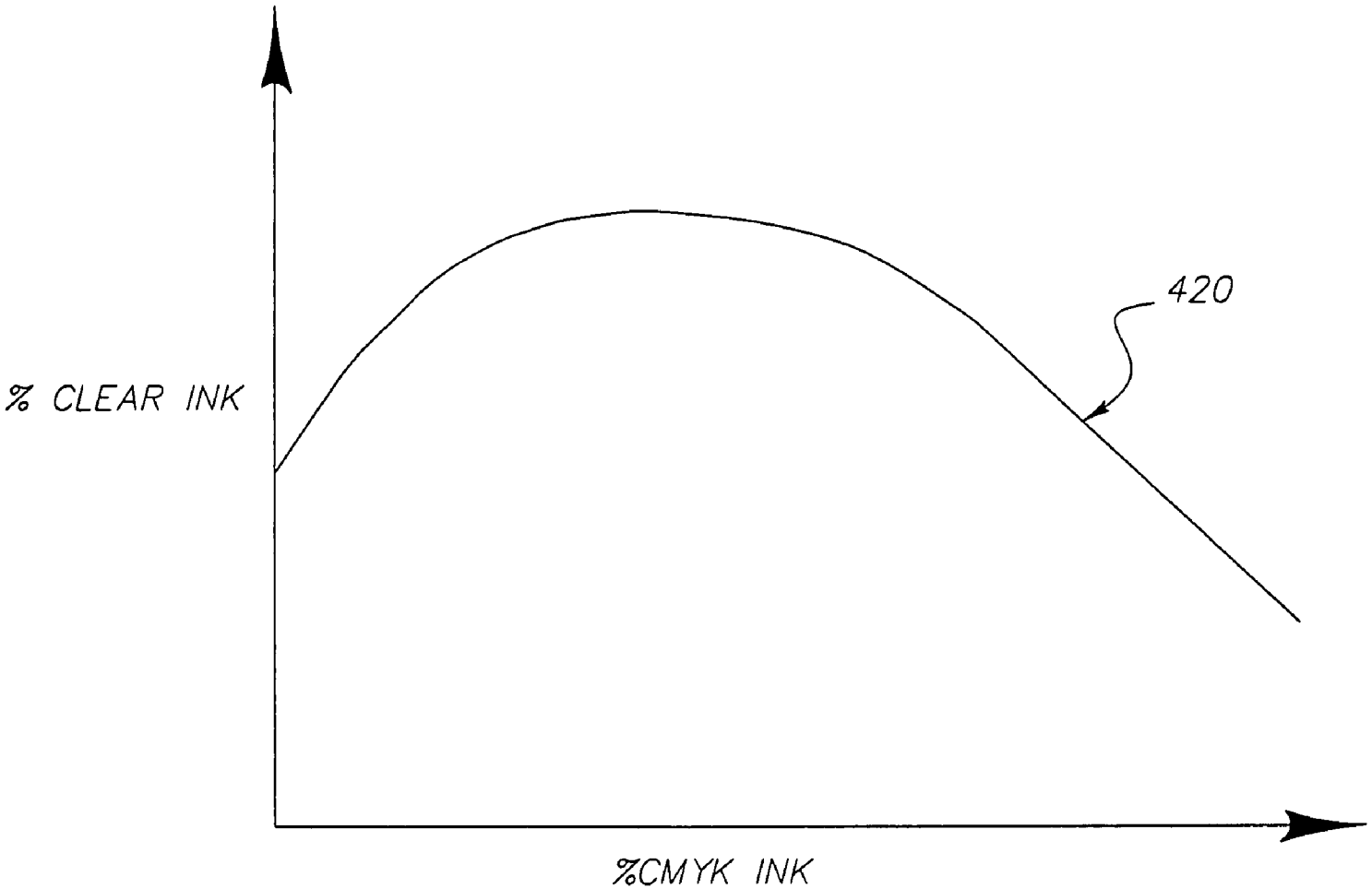
FIG. 4 shows a graph illustrating the exemplary amount of clear ink to be used versus the amount of color toner to achieve image features according to the present invention.

Referring now to FIG. 4, there is shown a graph of the amount of clear ink (transparent toner) usable in conjunction with the amount of four-color lay-down (% CMYK) in order to achieve certain results. More specifically, based on the user's selection of at least one of desired gloss, desired differential gloss and desired relief image, the graph of FIG. 4, according to one method of the present invention, may help determine the negative mask calculations required in step 220 of FIG. 2.

Alternatively, the determination of the negative mask calculations required in step 220 of FIG. 2A may be determined, in one embodiment of the present invention, by computer software encoded on a computer readable media. The computer software may have a code segment for obtaining a desired level of gloss and differential gloss from a user, reading an original image from which the printed image is to be made and calculating a color toner lay-down of the original image, and calculating an appropriate negative mask application of transparent toner based on at least one of the color toner lay-down of the original image, the desired level of gloss and differential gloss and the substrate.

Line 420 shows the desired negative mask calculation to achieve minimum color impact while matching substrate gloss for a glossy coated paper of intermediate level of gloss. In other words, if the user desires a print that would have a gloss value similar to the substrate gloss value, the amount of transparent toner negative mask to use on the substrate varies with the amount of four-color ink based on this curve.

EXAMPLES

Figure 5:
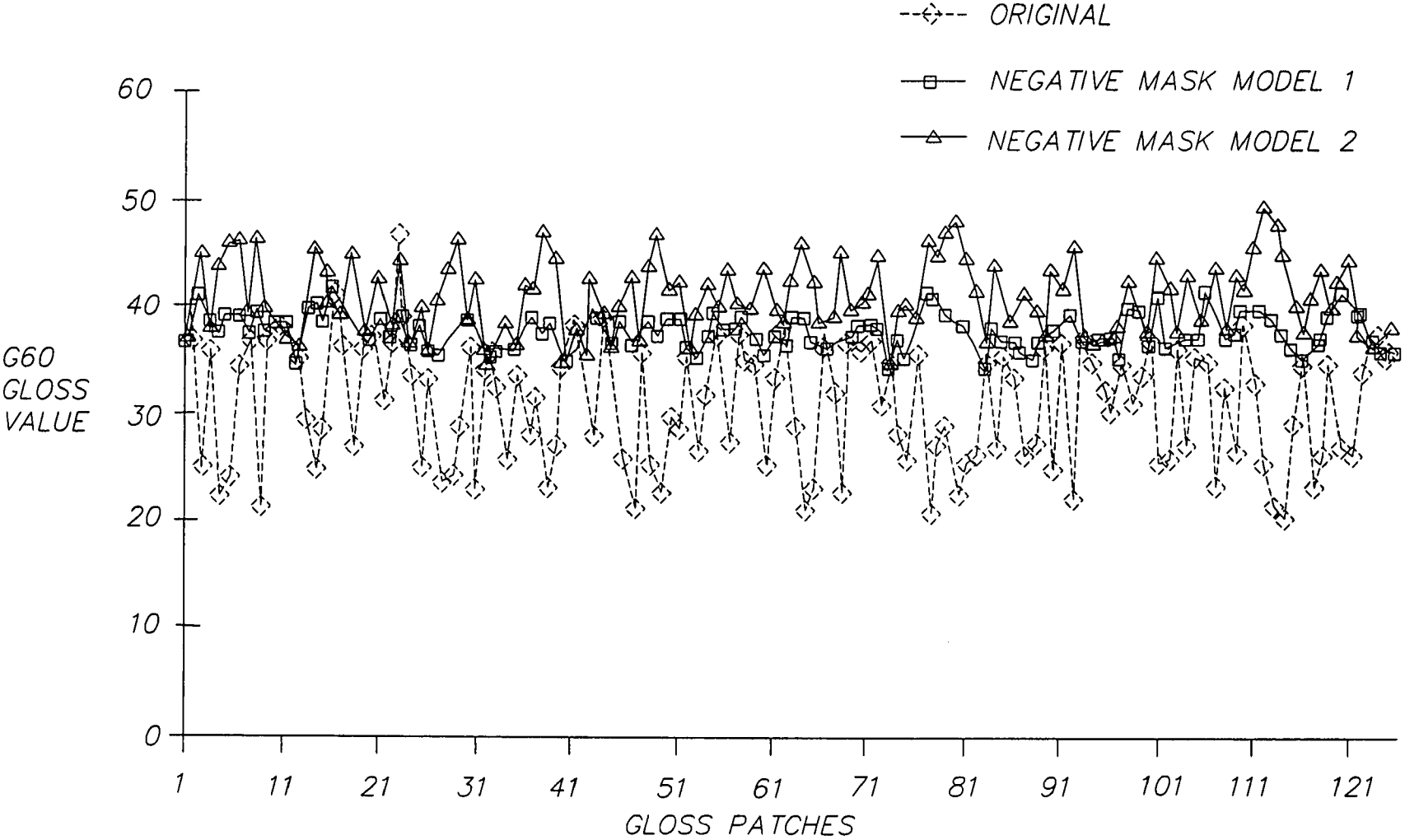
FIG. 5 shows a graph illustrating gloss uniformity when applying the negative mask method according to the present invention.

Referring to FIG. 5, there is shown a graph illustrating gloss uniformity when applying the negative mask method according to the present invention. The x-axis of the graph represents various color patches of a printed image, having varying percentages of color lay-down. The y-axis shows the gloss value. For these experiments, a glossy coated paper was used (Lustro Gloss 118) and two different transparent toner negative mask models were used to obtain a maximum gloss of 40 (square-indicated graph) and a maximum gloss of 50 (triangle-indicated graph). The results show that, with no transparent toner negative mask, the gloss value varied from about 20 to about 40 (a differential gloss of about 20). Using the negative mask model of the present invention, the gloss varied from about 35 to about 40 with the NMaxG40 negative mask model and from about 35 to about 50 with the NMaxG50 negative mask model. As can be seen, lower differential gloss and high overall gloss may be achieved by the negative mask method according to the present invention.

It should be understood, of course, that the foregoing relates to exemplary embodiments of the invention and that modifications may be made without departing from the spirit and scope of the invention as set forth in the following claims.

PARTS LIST

A, B, C, D, F, and G sub-processes
200 glossy coated paper substrate
202 four-color toner lay-down step
204 fusing step
206 in-line/off-line UV overcoat step
210 fusing step
212 fifth station ink jet step
220 fifth station negative mask transparent toner step
222 fusing step
224 in-line/off-line ink jet/UV coat step
226 fusing step
228 in-line ink jet UV overcoat step
230 fifth station transparent toner overcoat step
232 fusing step
234 fusing step
300 matte coated paper
302 four-color toner lay-down step
310 fifth station transparent toner lay-down step
312 ink jet or UV overcoat
314 result step
420 minimum color impact/match substrate gloss line
500 paper path
502 substrate
510 printing device
520 four-color lay-down section
530 fifth-section transparent toner lay-down section
540 roller fuser
550 section (for post-finishing step)
560 belt fuser

What is claimed is:

1. A method for controlling gloss and/or differential gloss of a printed image comprising:

applying a color toner lay-down onto a media substrate to form a pre-fused image;

determining image height of the prefused image;

determining a negative mask of transparent toner based on the prefused image height, desired gloss and/or differential gloss;

applying the transparent toner over the prefused image;

fusing said pre-fused image to form a fused print.

2. The method according to claim 1, further comprising finishing said fused print to increase a gloss value of said fused print.

3. The method according to claim 1, wherein said transparent toner is applied over an entirety of said pre-fused image.

4. The method according to claim 1, wherein said transparent toner is applied in varying amounts over said pre-fused image.

5. The method according to claim 2, wherein said finishing step comprises applying one of an in-line ink jet ink overcoat and an off-line ink jet overcoat.

6. The method according to claim 5, further comprising belt fusing said fused print to achieve at least one of an adjusted gloss value and a reduction in image relief.

7. A computer readable media for controlling gloss, differential gloss and image height of a printed image on a substrate comprising: a code segment for obtaining a desired level of gloss and differential gloss from a user; a code segment for reading an original image from which said printed image is to be made and calculating an image height of a color toner lay-down of said original image; a code segment for calculating an appropriate negative mask application of transparent toner based on the image height of said color toner lay-down of said original image, said desired level of gloss and said differential gloss and said substrate; and a code segment for applying the transparent toner over the color toner lay-down; and a code segment for fusing an image formed by the color toner lay-down and the transparent toner to form a fused print.

8. The computer readable media according to claim 7, further comprising a code segment for applying at least one of an in-line ink jet overcoat application device, an off-line ink jet overcoat application device, an in-line ultraviolet overcoat application device and an off-line ultraviolet overcoat application device, based on said desired level of gloss and differential gloss.

9. A computer readable media for controlling image height of a printed image on a substrate comprising: a code segment for reading an original image from which said printed image is to be made and calculating an image height of a color toner lay-down of said original image; a code segment for calculating an appropriate negative mask application of transparent toner based on the image height of said color toner lay-down of said original image; and a code segment for applying the transparent toner over the color toner lay-down; and a code segment for fusing an image formed by the color toner lay-down and the transparent toner to form a fused print.

* * * * *